US006148544A

United States Patent [19]

Keen et al.

[11] Patent Number: 6,148,544

[45] Date of Patent: Nov. 21, 2000

[54] GAITER FOR RUNNING SHOE

[75] Inventors: Martin W. Keen, Jamestown, R.I.; Gary M. Siriano, Norton, Mass.

[73] Assignee: Spalding Sports Worldwide, Inc., Chicopee, Mass.

[21] Appl. No.: 09/238,390

[22] Filed: Jan. 27, 1999

[51] Int. Cl.[7] ..... A43B 3/00; A43B 5/06

[52] U.S. Cl. ..... 36/1.5; 36/129; 36/114; 36/54

[58] Field of Search ..... 36/1.5, 2 R, 129, 36/114, 54, 4

[56] References Cited

U.S. PATENT DOCUMENTS

| | | | |
|---|---|---|---|
| 1,803,554 | 5/1931 | Knilans . | |
| 2,054,958 | 9/1936 | Tousley . | |
| 2,230,291 | 2/1941 | Evans . | |
| 2,824,390 | 2/1958 | Walker . | |
| 4,677,765 | 7/1987 | Lubet et al. | 36/1.5 |
| 4,693,018 | 9/1987 | Maleyko et al. | 36/1.5 |
| 4,736,531 | 4/1988 | Richard | 36/114 |
| 4,809,447 | 3/1989 | Pacanowsky et al. . | |
| 4,856,207 | 8/1989 | Datson . | |
| 4,930,175 | 6/1990 | Chen | 12/142 R |
| 5,117,568 | 6/1992 | Mitsui | 36/54 |
| 5,249,375 | 10/1993 | Tabarly . | |
| 5,337,493 | 8/1994 | Hill | 36/54 |
| 5,513,450 | 5/1996 | Aviles Palazzo . | |
| 5,642,573 | 7/1997 | Brown | 36/2 R |
| 5,664,343 | 9/1997 | Byrne | 36/55 |
| 5,784,806 | 7/1998 | Wendt . | |

*Primary Examiner*—Ted Kavanaugh

[57] ABSTRACT

A gaiter of flexible, substantially water-proof material, attached to the vamp portion and heel collar of a shoe upper. Preferably, the gaiter is a permanent, integral part of the shoe, due to a continuous stitching of the gaiter to the heel collar and eyelet stay along the vamp region of the upper. In a particular implementation, the gaiter has an elongated tongue portion extending along and underlying the tongue slot in the vamp region, and attached to the eyelet stays of the slot. A substantially tubular riser portion of the gaiter is integral with the tongue portion and is attached to and extends upwardly from the heel collar, to an open end. Conventional means, such as shoe laces, engage the eyelet stays directly or indirectly, for tightening the vamp over the wearer's instep. With the invention, however, the tongue of the shoe is constituted by the extension of the gaiter and therefore no water or debris can enter the forepart of the shoe through the vamp region.

24 Claims, 6 Drawing Sheets

GAITER FOR RUNNING SHOE

BACKGROUND OF THE INVENTION

The present invention relates to athletic shoes, particularly running shoes, which are suitable for use during inclement weather.

Running as a recreational activity has developed a large, enthusiastic following. This is attributable to a variety of advantages and benefits including easy accessibility, and improved feelings of energy and well-being in daily life. In this regard, running has for many participants, become an essential activity to be undertaken every day, rain or shine. On rainy days and with conventional running shoes, it is inevitable that rain water will work its way through the heel collar and/or vamp area of the running shoe, eventually soaking the socks and undermining optimal performance of the shoe. Moreover, extended running with wet socks can produce blisters or other irritation. Also during inclement weather, "kicked up" debris may enter the shoe and, especially if combined with the wet conditions, cause even greater discomfort.

The problem of keeping rain and/or debris away from the feet has been addressed to some extent with respect to other types of shoes or boots. Techniques are known for attaching protective collars or the like to, e.g., ski boots, hiking boots, and even dress shoes, to keep out debris or water, but the soles and uppers of such shoes are designed for providing strong support and durability, not the cushioning and flexibility normally associated with "athletic shoes". As used herein, the term "athletic shoe" means a shoe having (a) an outer sole for impact contact with the ground during which the outer sole experiences significant longitudinal bending, (b) a midsole providing cushion support during such impact, (c) an upper which is more flexible than the outer sole and which is drawn around the foot below the ankle, (d) whereby the ankle and instep can flex longitudinally without significant restriction. Athletic shoes in this context include shoes for running sports, jogging, and spirited walking.

SUMMARY OF THE INVENTION

It is, accordingly, an object of the present invention to provide an athletic shoe, particularly a running shoe, adapted for use in inclement weather.

It is a further object to provide a running shoe which, in addition to keeping out rain and debris from the upper portion of the running shoe, achieves this end without adding significant weight, and without increasing restriction in use or while putting on or taking off the running shoe.

It is a more general object to provide a gaiter construction that can be adapted for use to achieve high water and debris protection in variety of shoe types.

These objects are achieved in a general aspect of the invention, by providing a gaiter of flexible, substantially water-proof material, attached to the vamp portion and heel collar of the shoe upper. Preferably, the gaiter is a permanent, integral part of the shoe, by virtue of a continuous stitching of the gaiter to the heel collar and eyelet stay along the vamp region of the upper.

In a particular implementation of the invention, the gaiter is a substantially waterproof fabric material, having an elongated tongue portion extending along and underlying the tongue slot in the vamp region, and attached to the eyelet stays of the slot. A substantially tubular riser portion of the gaiter is integral with the tongue portion and is attached to and extends upwardly from the heel collar, to an open end.

Conventional means, such as shoe laces, engage the eyelet stays directly or indirectly, for tightening the vamp over the wearer's instep. With the invention, however, the tongue of the shoe is constituted by the extension of the gaiter and therefore no water or debris can enter the forepart of the shoe through the vamp region. A draw cord or similar means is also provided at the open end of the riser portion of the gaiter, for drawing around the wearer's ankle, thereby preventing water from draining down along the wearer's pantleg, or splashing, into the heel collar.

In the preferred embodiment, which combines waterproof functionality with comfort, the gaiter has an outer layer of abrasion-resistant polymeric material such as nylon, and a substantially coextensive inner layer of material which prevents the ingress of liquid water but permits the egress of water vapor, e.g., Goretex fabric. Preferably, the front of the outer layer of the riser portion and the tongue outer layer are formed by two panels of stretch nylon sewn together along a seam extending from the open end of the riser, down the vamp, to the toe. The front inner layer and the tongue inner layer are formed by one seamless panel of, preferably Goretex stretch fabric, extending from the open end of the riser to the toe. Preferably, only the outer layers of the front, back and tongue portions are sewn to the upper, i.e., along a substantially continuous seam around the heel collar and the eye stays.

In yet a further preference, the interior surface of the shoe upper is covered by a water-resistant, breathable laminate, e.g., including a Goretex membrane. Whereas the outer layer of the gaiter is sewn to the shoe upper, the inner layer of the gaiter is bonded to the membrane.

It can be appreciated that the flexible, cloth-like material constituting the gaiter does not detract from the running performance of the shoe, yet it achieves the significant advantage of keeping water out of the shoe interior. Furthermore, the flexible, fabric nature of the gaiter, does not interfere with inserting or removing the foot from the shoe. Because in the preferred embodiment, the gaiter is an integral part of the shoe, there is no need for remembering the storage location of the gaiter for ready availability in the event of inclement weather, and there is furthermore no need for any time to be taken for attaching or detaching the gaiter before and after use.

The integration of the gaiter with the shoe therefore achieves comfort and convenience, as well as waterproofing, for at least three important reasons. First, the flexible outer layer provides a first level of debris blockage and water repulsion, which is preserved in part by the continuous seam between the outer layer and the upper edge of the shoe upper. Second, the main water-proofing arising from the flexible Goretex or similar inner layer of the gaiter, avoids seams at those locations where water would be most likely to penetrate. The inner layer is preferably bonded within the shoe upper, to a water proof inner membrane, forming a continuous "sock" of water-proof protection. Finally, the shape and orientation of the stitching between panels and between gaiter and shoe upper, preserves flexibility to conform the gaiter to the user's foot under the variety of contorted positions that may be encountered during running.

BRIEF DESCRIPTION OF THE DRAWINGS

These and other objects and advantages of the invention will be understood in greater detail from the following description of the preferred embodiments, made with reference to the accompanying drawings, in which.

DESCRIPTION OF THE PREFERRED EMBODIMENT

Figure 1:
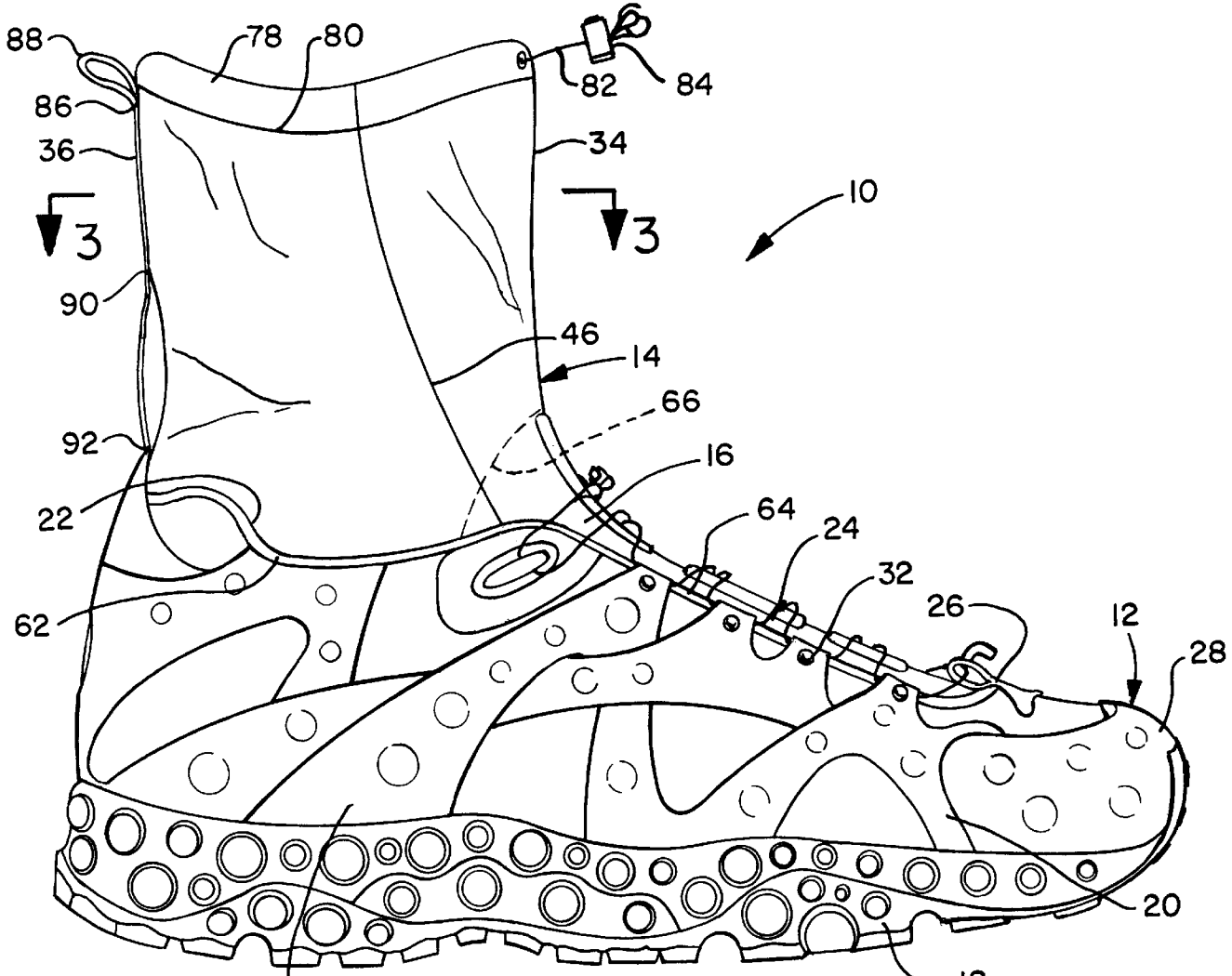
FIG. 1 is a side elevation view of a running shoe in accordance with the present invention (showing the lateral side of the right shoe)
Figure 2:
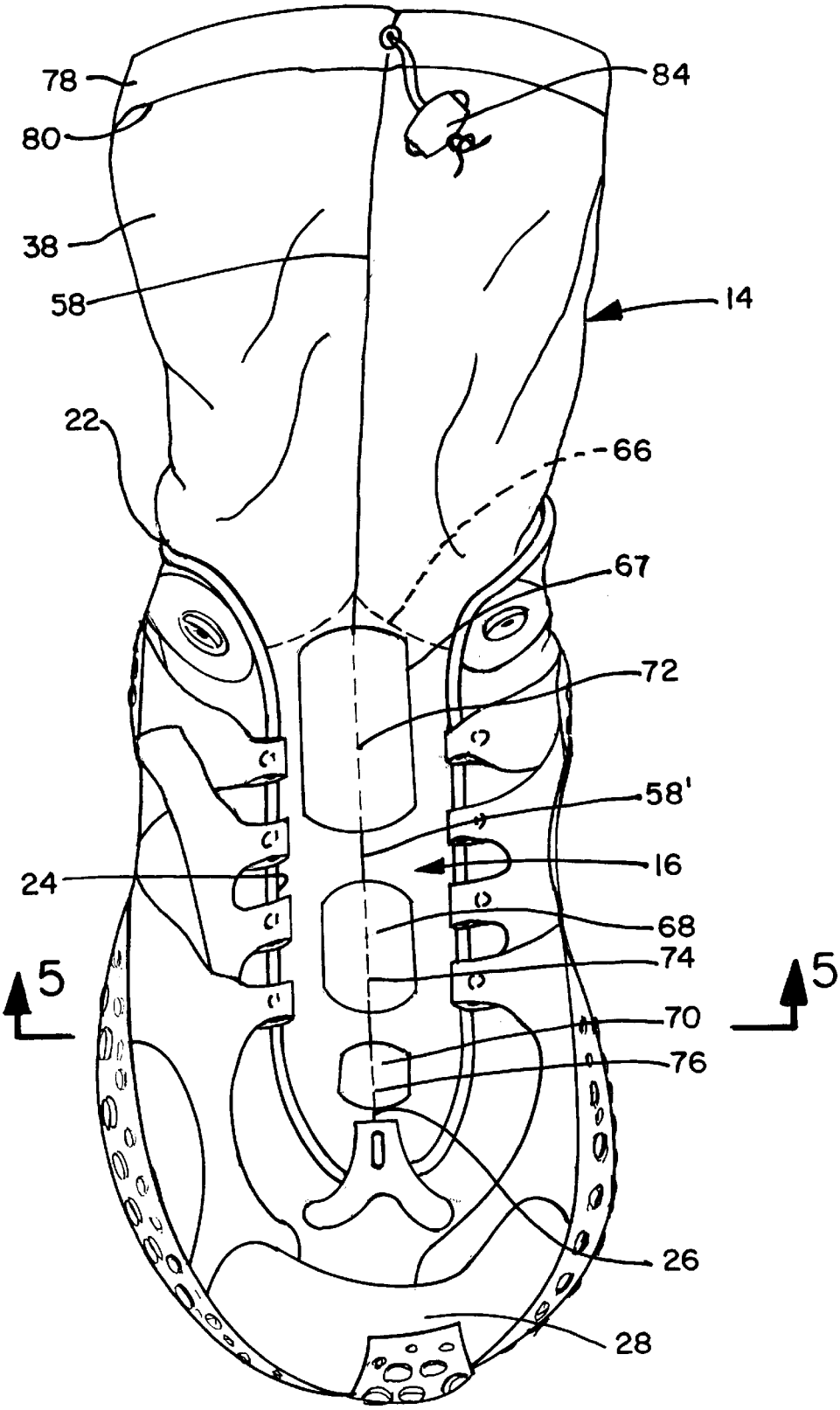
FIG. 2 is a view of the shoe of FIG. 1, as seen by an observer looking down at the vamp region.

FIGS. 1 and 2 show a shoe system 10 in accordance with the invention, wherein the system includes a running shoe 12 and a gaiter 14. The shoe 12 has a firm but not rigid, sole including abrasion resistant outer sole 12 for contacting the ground, and a relatively more flexible upper 20 with upper edges defining a heel collar 22 below the ankle and a pair of opposed eyelet stays 24. It should be understood that the eyelet stays can be considered as the boundary of the upper along the slot typically provided for overlaying the tongue in the vamp region 26, between the toe 28 and the heel collar 22. An eyelet web or similar structure 30 including eyelets 32 are typically arranged on either side of the eyelet stay 24, for engaging means, such as shoe laces or the like, to draw the opposed eyelet stays toward each other over the tongue, thereby tightening the shoe against the wearer's instep and, in general, better conforming the shoe to the wearer's foot. The gaiter 14 has an upright, substantially tubular riser portion and an integral tongue portion 16 which extends forwardly into the vamp region 26.

It should be appreciated that a variety of running shoes are available in the marketplace, including those made entirely or partly of leather, hide-like polymeric or other synthetic material, and web-like or fabric material. In particular, running shoes having a combination of polymeric material and water-proof or water-resistant cloth or fabric, such as Goretex material, are known. However, use of such waterproof materials is primarily intended to keep water from penetrating up through the sole or through the upper, but this does not afford protection for rain or debris that falls vertically downward against the shoe or wearer's ankle and which can therefore work its way alongside the heel collar or eyelet stays onto the socks of the wearer.

The gaiter 14 according to the invention, especially with tongue extension 16, overcomes this problem by isolating the heel collar and vamp region from water and debris.

Figure 3:
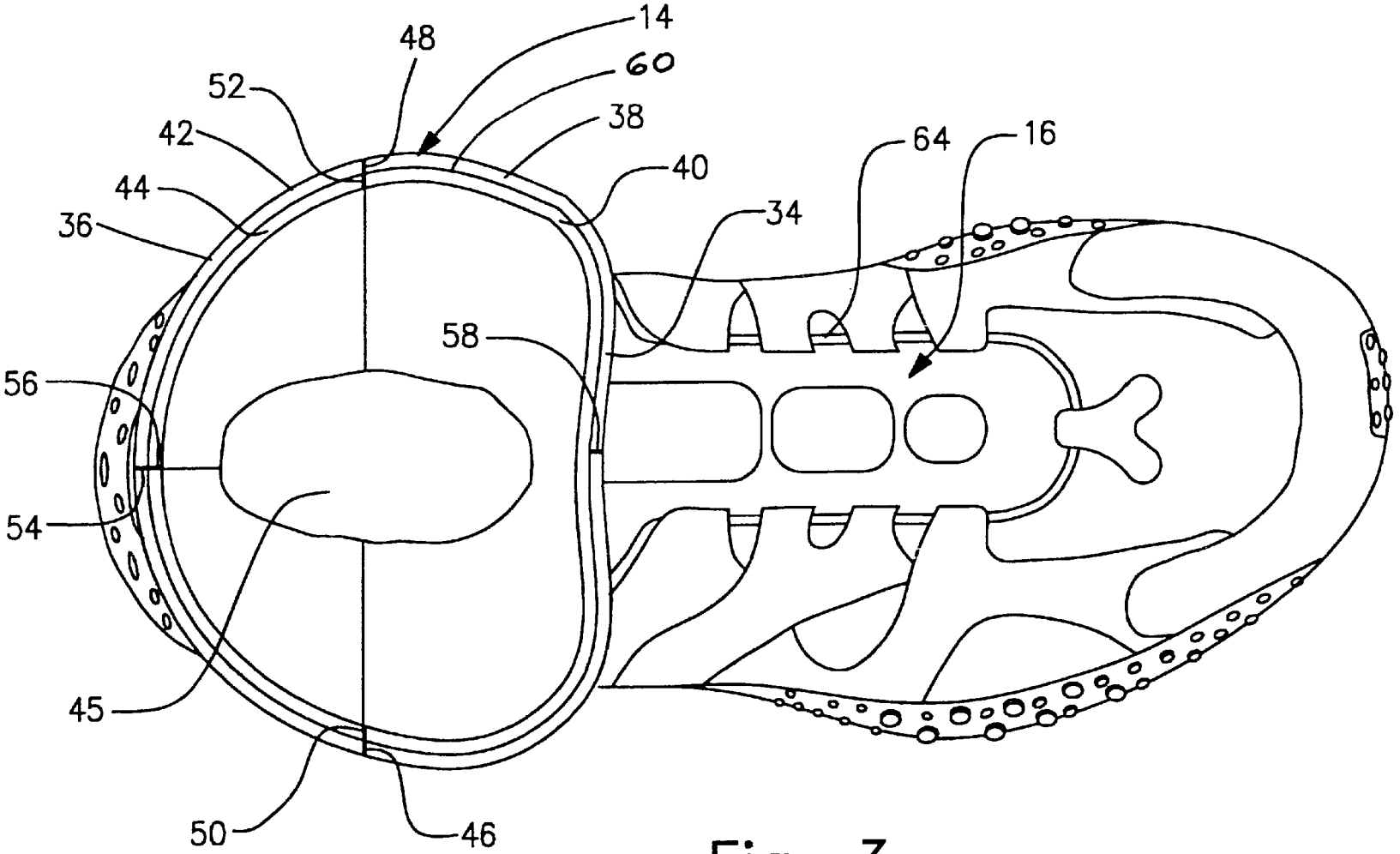
FIG. 3 is a section view of the gaiter portion of the shoe, taken along line 3—3 of FIG. 1.

With further reference to FIG. 3, the gaiter is shown as having a front portion 34 and a back portion 36, which portions are constituted by two layers of cloth or fabric-like material. The front portion 34 preferably is constituted by an outer layer 38 of stretch nylon (such as available under the Lycra and Cordura trademarks), and an inner layer 40 of stretch Goretex material, or similar material which substantially prevents the ingress of liquid water while permitting the egress of water vapor which arises in the form of sweat during running. The back portion 36 is preferably formed of an outer layer of Taslon nylon 42 and an inner layer of regular Gortex material 44. As viewed from above in FIG. 3, the gaiter 14 presents a substantially circular opening which tapers to some extent inwardly but provides ready access for the user's foot to enter the opening and slide to the end position with the heel of the foot against the heel 45 of the upper 20.

Figures 4, 4A, 4B:
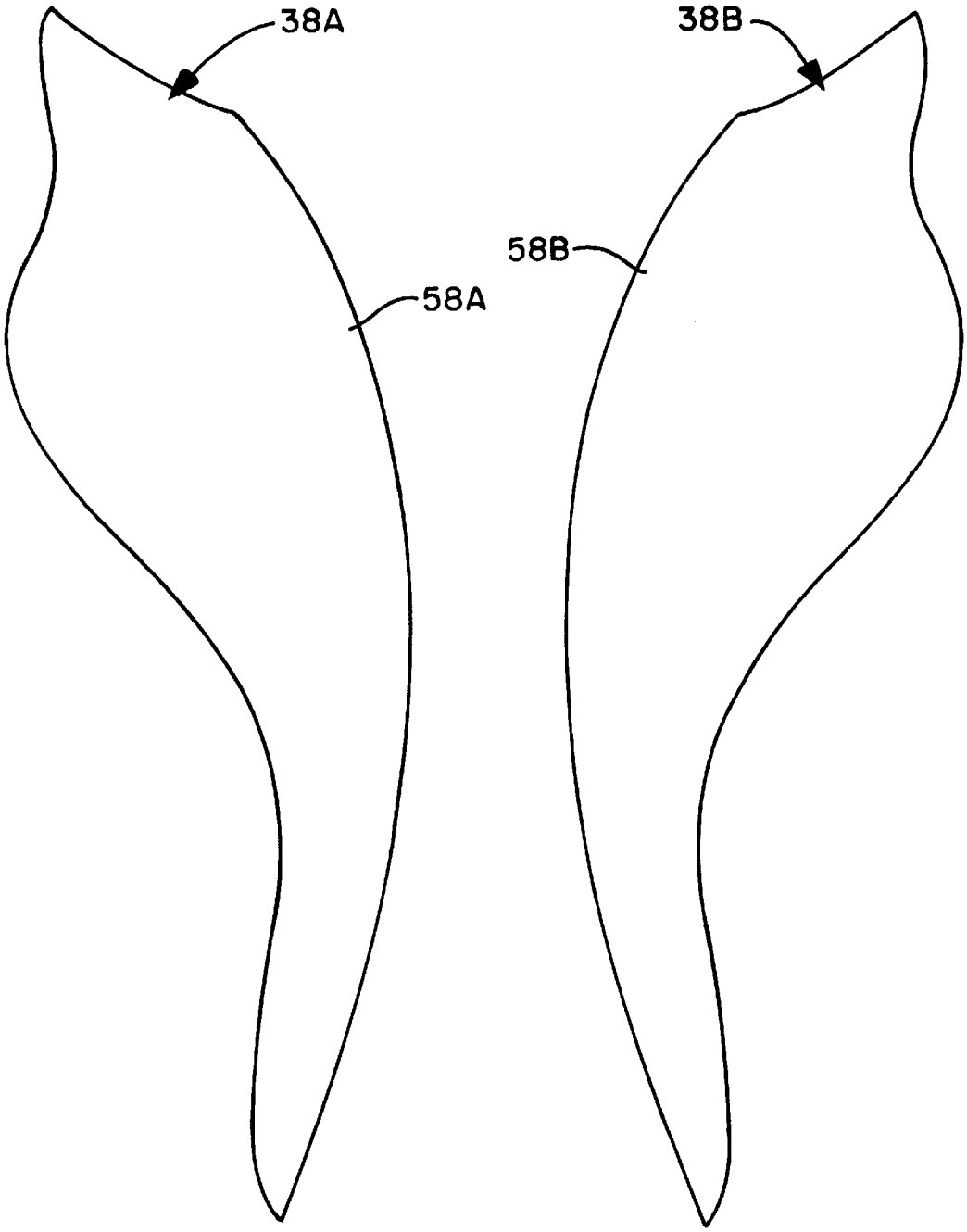
FIG. 4 is a plan view of the two fabric panels which when sewn together, constitute the outer layer of the front and tongue portions of the gaiter.

FIG. 4 shows the preferred manner of constructing the outer front layer 38 such that the outer surface of the tongue extension 16 is automatically formed as well. Two mirror-image panels 38A and 38B are sewn along confronting edges 58A,58B respectively. Preferably, the front inner layer 40 is not sewn at the front, but only at the lateral inner seam 50 and medial inner seam 52. Similarly, the nylon 42 of the back outer layer is sewn to the outer front layer 34, at medial outer seam 48 and lateral outer seam 46. The two outer back panels are preferably sewn together at the back outer seam 54, and the back inner layers 44 are preferably sewn together at the back inner seam 56. Preferably, the inner and outer layers are not sewn to each other, but rather a space 60 is present therebetween. It should be appreciated that the term "space" does not imply that a uniform gap is maintained between the layers, but rather that these layers are not joined and are therefore free to slide slightly relative to each other. Not only does this provide greater comfort, but importantly, the Goretex material has no seam at the front of the gaiter, and at the back and sides, is sewn only to other Goretex material without penetration of the outer layer.

Figure 5:
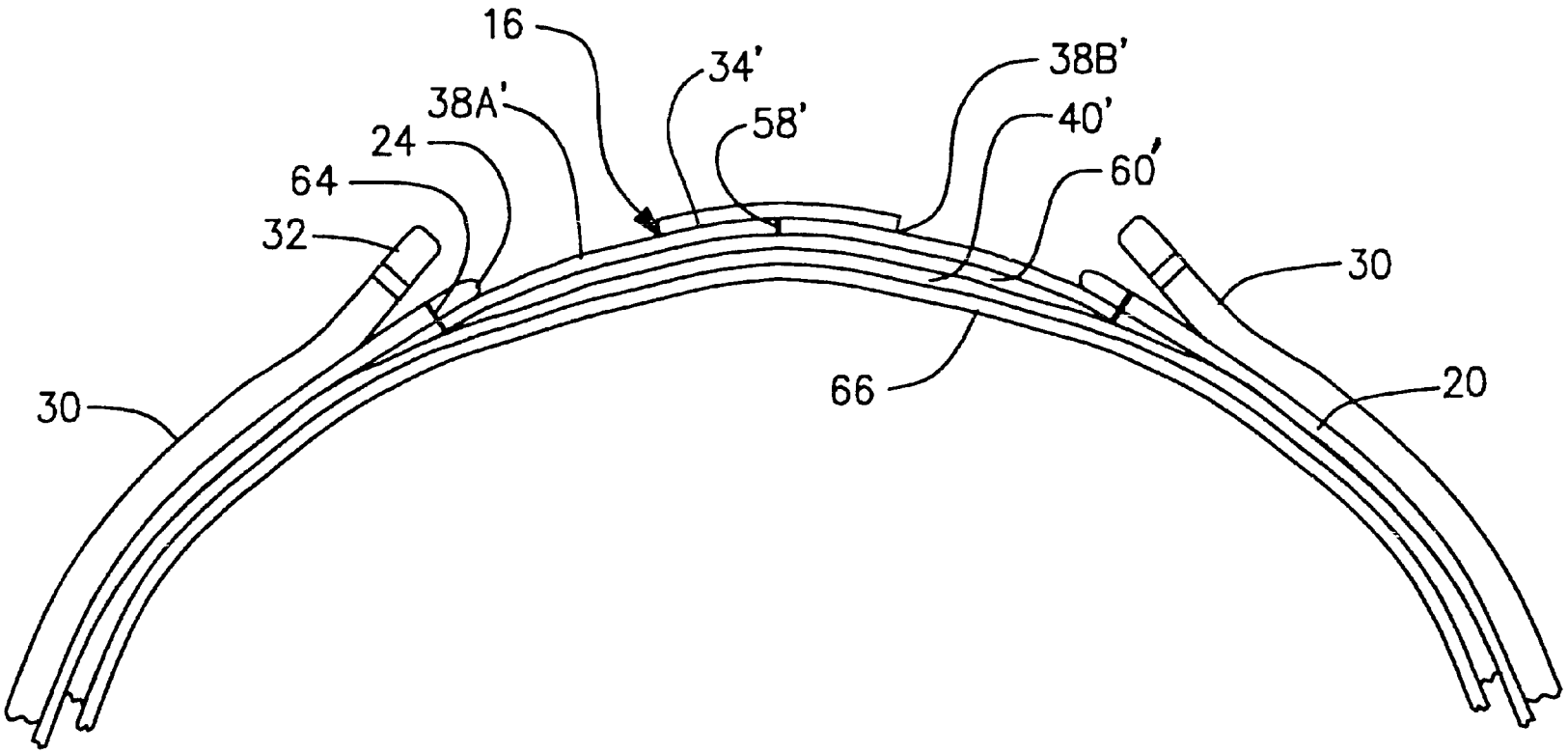
FIG. 5 is a cross-sectional view of the vamp region of the shoe, taken along line 5—5 of FIG. 2.

This is also evident in FIG. 5, where it may be seen that the outer layer of the tongue extension (constituted by panels 38A' and 38B') are joined by seam 58' to each other, and by Seams 64 to the eyelet stays 32. The inner layer 40' of qoretex material is not sewn to the upper, but rather may be boned as by adhesive to the outer layer, or left as a sock-like enclosure. In any event, this absence of affixation to outer layer 38, is indicated by space 60'.

As also shown in FIGS. 1 and 2, a highly abrasion resistant and waterproof yet breathable membrane 66 is adhered to the interior of the upper and is also adhered to the inner layer 40, 44 of the gaiter. This bonding occurs substantially along and below the edge of the upper defined by the heel collar 22 and the eyelet stays 24, except that it may be preferable for the membrane 66 to extend upwardly from the upper as shown in FIG. 1, at the instep for added protection. The preferred membrane 66 is the Durakool material, available from the same sources as Goretex material.

Figure 6:
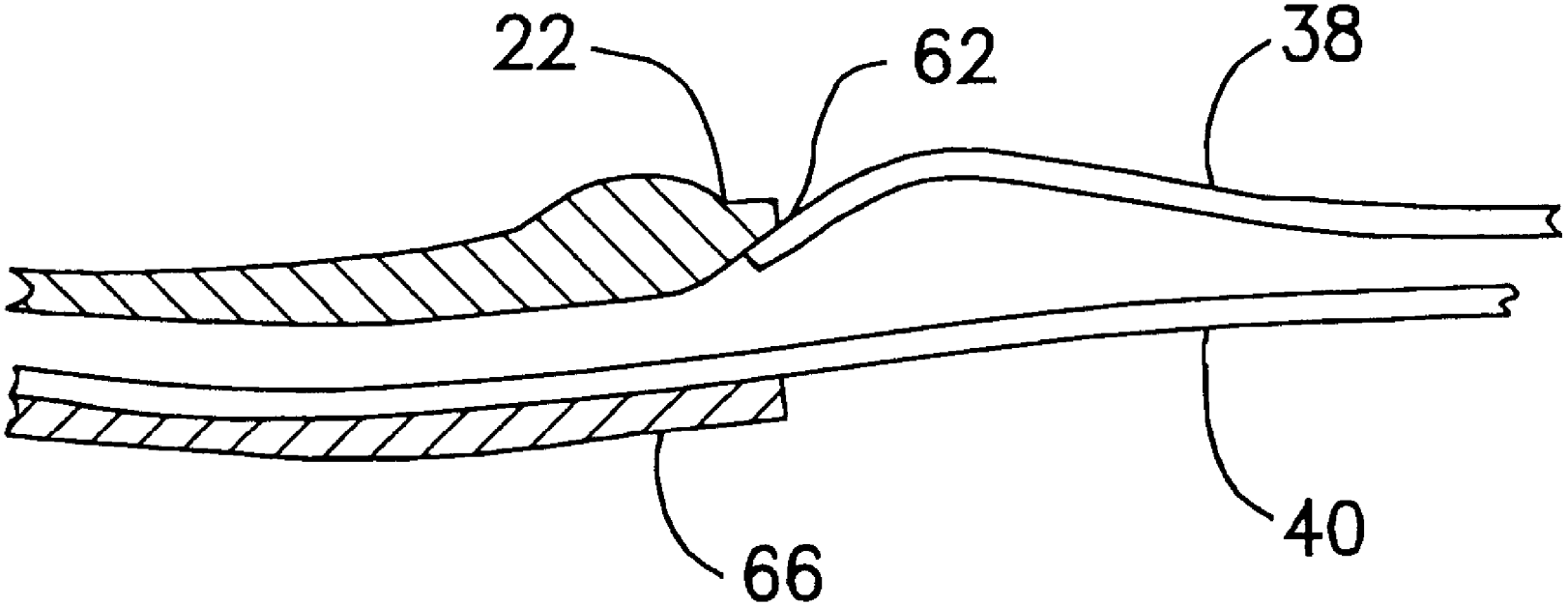
FIG. 6 is a cross-sectional view of the preferred connection of the gaiter portion to the heel collar.

On the other hand, the stitching of the outer layer 38 as shown in FIG. 5, to the upper at 64, extends along the vamp from the toe along both sides of the slot between the eyelet stays, and along the heel collar, in a substantially continuous, unbroken line. The connection of the front part of outer layer 38 to the heel collar 22 via seam 62, is shown in FIG. 6. The front part of inner layer 40 is not stitched to the heel collar 22, but is connected to outer layer 38 only at a seam near the open upper end of the riser portion of the gaiter. The outer back portion 42 is similarly connected to the collar 22 and to inner back portion 44. The membrane 66 and laminated or bonded layers 40 and 44, extend downwardly into and laterally through the sole (not shown) to form a substantially waterproof "bootie" at the bottom, sides, and instep of the foot, in a somewhat conventional manner.

The aspect of the invention whereby a forward extension of the gaiter constitutes a waterproof, integral tongue for the upper, can be implemented in a wide variety of shoes having a vamp slot extending from the heel collar to the toe, with flaps or the like defining the margin of the slot and overlaying the tongue. Closure of the vamp need not be limited to laces.

For athletic shoes, the means for tightening or closing the vamp can comprise a typical shoe lace which the user ties in a knot, or a more convenient spring loaded lace lock device or the like. The closure means would typically cross multiple times between the two edges or flaps of the eyelet stays and during use, rub against the outer layer 38. Therefore, it is preferred that a plurality of hide-like pads 67,68 and 70 be sewn with seam 72,74, and 76 to the outer layer of the gaiter in the vamp region, to provide the abrasion resistant surfaces and thereby protect the fabric of the outer layer. The seams on the pads run in the direction from the toe to the heel of the shoe, and preferably are in registry with the seam 58 which also extends in that direction, such that these seams provide the least resistance to bending for assuring comfortable and unrestricted strides.

As shown in FIGS. 1 and 2, the gaiter 14 preferably includes a drawstring 82 at the open upper end, where the inner and outer layers may be folded over and stitched at 80 with the string 82 entrapped therein, for tightening the lace lock 84 or the like at the front. A lifting strap 86 is also preferably provided, having one end attached to the back of heel at 92 of the upper 20, one or more intermediate stitches such as 86, 90 to the back of the gaiter, and a loop 88 which facilitates pulling of the rear portion of the shoe against the foot as the foot is inserted through the gaiter 14 into the upper 20.

It should be appreciated that the particular materials described herein can be substituted by materials having similar functionality. In general, the outer layer of the gaiter is designed for abrasion resistance and debris resistance, as well as a first level of water repellence. Where stretch is not needed, this can be Taslon nylon, and where stretch is needed, it can be stretch Cordura nylon. The inner layer is a Gore material, preferably stretch Gore for the front. Generally, the outer layer will be polymeric and the inner layer will prevent the ingress of liquid water but permit the egress of water vapor.

A preferred aspect of the invention is the integral shoe tongue 16, which is in essence formed as an extension of the gaiter riser forwardly through the vamp to the toe, rather than as can be found in a conventional shoe, where the tongue is attached to the upper and terminates in the vicinity of the forward portion of the heel collar. As can be appreciated from inspection of FIGS. 2 and 5, the tongue extension 16 has an overall greater bulk or thickness than the riser portion of the gaiter 14, because it is constituted not only from outer and inner layers 38,40, but also from the intimate presence of Gore or other waterproof membrane 66. Furthermore, the abrasion resistant pads occupy a substantial area and in practice, provide further bulk such that the tongue effectively performs as if it were constituted by four layers of material, rather than two. This provides the wearer with the "feel" of a conventional tongue, but in fact offers less tension at the instep while affording waterproofing. Moreover, this also achieves an efficiency during manufacture, in that separate tongues for the upper and gaiter are not required.

What is claimed is:

1. A running shoe comprising:

a sole for contacting the ground;

an upper attached to the sole and having a toe, a vamp having a slot with a periphery, and a heel with a collar and;

a gaiter of flexible, substantially water proof material, attached to the upper such that the gaiter generally extends from substantially the entire periphery of the slot and upwardly from the heel collar, wherein the gaiter is sewn to the upper in a substantially continuous line along the vamp and the heel collar.

2. A running shoe comprising:

a sole for contacting the ground;

an upper attached to the sole and having a toe, a vamp having a slot with a periphery, and a heel with a collar and;

a gaiter of flexible, substantially water proof material, attached to the upper such that the gaiter generally extends from substantially the entire periphery of the slot and upwardly from the heel collar, wherein the gaiter is formed by substantially coextensive, inner and outer, fabric-like layers; and the outer layer is more abrasion resistant than the inner layer and the inner layer is a material which substantially prevents the ingress of liquid water while permitting the egress of water vapor, wherein the gaiter is sewn to the upper in a substantially continuous line along the vamp and the heel collar.

3. The running shoe of claim 2, wherein only the outer layer is sewn to the upper.

4. The running shoe of claim 3, wherein the inner layer has a front portion of a first type of stretchable material and the outer layer has a front portion of a second type of stretchable material.

5. An athletic shoe, comprising:

a sole for contacting the ground;

an upper attached to the sole and having a toe, a vamp, and a heel, wherein the vamp includes a slot bordered by eyelet stays and the heel includes a heel collar;

a gaiter of flexible, substantially water proof material, having an elongated tongue portion extending along and underlying the slot and attached to the eyelet stays, and a substantially tubular riser portion integral with the tongue portion and attached to and extending upwardly from the heel collar to an open end;

means engaging the eyelet stays for tightening the vamp over the wearer's instep; and means for tightening the open end of the gaiter riser, around the wearer's ankle.

6. The shoe of claim 5, wherein the gaiter has an outer layer of abrasion resistant polymeric material and an inner layer of material which substantially prevents the ingress of liquid water but permits the egress of water vapor.

7. The shoe of claim 5, wherein the riser portion has a front having inner and outer layers of respective first and second materials, and a back having inner and outer layers of respective third and fourth materials, and the tongue portion has inner and outer layers of said first and second materials, extending from the front of the riser portion.

8. The shoe of claim 7, wherein only the outer layer of the tongue portion, is sewn to the eyelet stays.

9. The shoe of claim 8, wherein only the outer layers of the riser are sewn to the heel collar.

10. The shoe of claim 7, where the gaiter is sewn substantially continuously along the eyelet stays and the heel collar.

11. The shoe of claim 10, wherein only the outer layers of said front, back, and tongue portions are sewn to at least one of the eyelet stays and heel collar.

12. The shoe of claim 7, wherein the front outer layer is a stretch nylon fabric and the inner front layer is a stretch material which substantially prevents the ingress of liquid water while permitting the egress of water vapor.

13. The shoe of claim 7, wherein the front outer layer and the tongue outer layer are formed by two panels sewn together along a seam extending from the open end of the riser to the toe, and the front inner layer and the tongue inner layer are formed by one seamless panel extending from the open end of the riser to the toe.

14. The shoe of claim 13, wherein only the outer layers of said front, back, and tongue portions are joined along a substantially continuous seam to the eyelet stays and the heel collar.

15. The shoe of claim 5, wherein the upper has an interior surface for receiving the foot of the wearer and the interior surface is formed by a water resistant membrane.

16. The shoe of claim 15, wherein the gaiter has an outer layer of abrasion resistant polymeric material and an inner layer of material which prevents the ingress of liquid water but permits the egress of water vapor, the membrane is bonded to the inner layer of material of the gaiter, and the outer layer of the gaiter is sewn along a substantially continuous seam to the eyelet stays and the heel collar.

17. The shoe of claim 16, wherein a plurality of abrasion-resistant pads are attached to the tongue portion and lie on the tongue outer layer.

18. A shoe with integral gaiter, comprising:

a sole;

an upper attached to the sole and having a toe, a vamp, and a heel including a heel collar, wherein the vamp includes a slot extending from the heel collar to the toe and bordered by stay flaps;

a gaiter of flexible, substantially water proof material, having an elongated tongue portion extending along and underlying the slot and attached to the stay flaps along the length of the slot, and a substantially tubular riser portion integral with the tongue portion and attached to and extending upwardly from the heel collar to an open end.

19. The shoe of claim 18, wherein the gaiter has an outer layer of abrasion resistant polymeric material and an inner layer of material which prevents the ingress of liquid water but permits the egress of water vapor.

20. The shoe of claim 18, wherein the riser portion has a front having inner and outer layers of respective first and second materials, and a back having inner and outer layers of respective third and fourth materials, and the tongue portion has inner and outer layers of said first and second materials, extending from the front of the riser portion.

21. The shoe of claim 20, wherein only the outer layer of the tongue portion, is sewn to the stay flaps.

22. The shoe of claim 21, wherein only the outer layers of the riser are sewn to the heel collar.

23. The shoe of claim 20, wherein the front outer layer and the tongue outer layer are formed by two panels sewn together along a seam extending from the open end of the riser to the toe, and the front inner layer and the tongue inner layer are formed by one seamless panel extending from the open end of the riser to the toe.

24. The shoe of claim 23, wherein only the outer layers of said front, back, and tongue portions are joined along a substantially continuous seam to the stay flaps and the heel collar.

* * * * *